US008523582B2

(12) United States Patent
Balfour et al.

(10) Patent No.: US 8,523,582 B2
(45) Date of Patent: Sep. 3, 2013

(54) LOCATE WIRE CONNECTOR AND LOCATE WIRE GROUNDING METHOD

(75) Inventors: William J. Balfour, Torrington, CT (US); Randolph L. Auclair, New Hartford, CT (US)

(73) Assignee: Electric Motion Company, Inc., Winsted, CT (US)

( * ) Notice: Subject to any disclaimer, the term of this patent is extended or adjusted under 35 U.S.C. 154(b) by 32 days.

(21) Appl. No.: 13/362,472

(22) Filed: Jan. 31, 2012

(65) Prior Publication Data

US 2013/0196531 A1 Aug. 1, 2013

(51) Int. Cl.
*H01R 13/648* (2006.01)

(52) U.S. Cl.
USPC ..... 439/95

(58) Field of Classification Search
USPC ..... 439/95, 99, 91, 92, 96, 591, 83, 82, 439/751, 943
See application file for complete search history.

(56) References Cited

U.S. PATENT DOCUMENTS

| | | | | |
|---|---|---|---|---|
| 3,836,885 | A * | 9/1974 | Larsile | 439/341 |
| 3,860,739 | A * | 1/1975 | Kloth et al. | 174/503 |
| 4,500,746 | A * | 2/1985 | Meehan | 174/503 |
| 4,533,193 | A * | 8/1985 | Blackwood | 439/374 |
| 4,648,677 | A * | 3/1987 | Lang | 439/404 |

* cited by examiner

*Primary Examiner* — Tulsidas C Patel
*Assistant Examiner* — Phuongchi T Nguyen
(74) *Attorney, Agent, or Firm* — Alix, Yale & Ristas, LLP

(57) ABSTRACT

A locate wire connector provides a grounding wire connection for the locate wire of a fiber optic cable. The locate wire is partially separated from the fiber optic cable. A conductive stripper in the connector establishes electrical communication with the locate wire conductor upon placing the locate wire and fiber optic cable in the connector and closing same. A stud extending from the cover of the connector provides a terminal for connecting a ground wire. The connector may also contain a gel to ensure a waterproof grounding connection.

20 Claims, 7 Drawing Sheets

LOCATE WIRE CONNECTOR AND LOCATE WIRE GROUNDING METHOD

BACKGROUND

This disclosure relates generally to drop wire connections for connecting fiber optic cable to residences. More particularly, this disclosure to connectors and grounding techniques employed for locate wires for fiber optic cables.

Fiber optic cables which are employed underground typically have a locate wire which is attached to and extends with the fiber optic carrier. The locate wire is employed to locate the fiber optic cable underground. Typically, a tone is applied to the locate wire to locate the cable. Because the locate wire is electrically conductive, grounding is required. One conventional grounding technique employs stripping insulation from the locate wire and then bonding several locate wires together. In some installations a ground rod is employed since it is not desirable to ground the locate wires in an optical network unit (ONU).

SUMMARY

Briefly stated, a locate wire connector comprises a base. The base has a groove for a cable and a spaced groove for a locate wire. A cover is hinged to the base and has a first interior side and a second exterior side. A conductive member is mounted to the first side and forms a stripper slot alignable with the locate wire groove. A stud assembly is configured to connect a ground wire extending from the second side. The stud assembly is in electrical communication with the conductive member. When a cable is received in the cable groove, a locate wire is received in the locate wire groove and the cover is closed over the base, the stud assembly electrically communicates with the locate wire.

The cable groove and locate wire groove are each defined by transversely spaced recesses in opposed side panels of the base. The cable groove recess is restricted. The base comprises a bottom panel and a locate wire cradle extends from the bottom panel and is aligned with the locate wire groove. The cover further comprises a pair of tabs. The base has a pair of detents which receive the tabs when the cover is closed. The cover also has an extended bill.

The conductive member is a conductive plate which is bent perpendicularly at two transversely spaced locations and forms a pair of opposed stripper blades at each side of said slot. In a closed position, the stripper blades are disposed between the locate wire cradle and the locate wire grooves. The stud assembly comprises a threaded member having a head which engages against the conductive member and exteriorly receives a pair of nuts.

A method for grounding a locate wire comprises providing a hinge connector with a base and a hinge cover. The locate wire is partially separated from an optic cable. The locate wire and optic cable are placed in the base. The cover is closed to thereby establish electrical communication with the locate wire. A ground wire is connected to the cover to provide electrical communication between the ground wire and the locate wire.

The method further comprises displaying insulation from the locate wire as the cover closes onto the base. The step of partially separating the locate wire from an optic cable further comprises slitting the web between the locate wire and the optic cable. The method also comprises connecting a ground wire by tightening an end portion of the ground wire by torquing a nut mounted on the cover. A gel is placed in the connector prior to closing the cover. The method comprises securing the closed cover by forcing tabs of the cover into detents of the base.

A locate wire grounding installation comprises a fiber optic cable with a locate wire partially separated from the cable carrier. A connector captures the cable and locate wire in spaced separated relationship. A conductor member disposed interiorly of the connector electrically communicates with the locate wire and with an exteriorly accessible stud. A grounding wire is secured to the stud.

The locate wire has a central conductor covered by insulation. The connector comprises a pair of transversely spaced stripper blades which sever insulation on the locate wire and electrically communicate with the locate wire conductor. The stripper blades position and align the locate wire to prevent the stripper blades from severing the central conductor of the locate wire. A gel covers the stripper blades. The connector comprises a base and a hinge cover which pivots between an open and a closed position and captures the fiber optic cable and a separated portion of the locate wire in the closed position.

DETAILED DESCRIPTION

Figure 2:
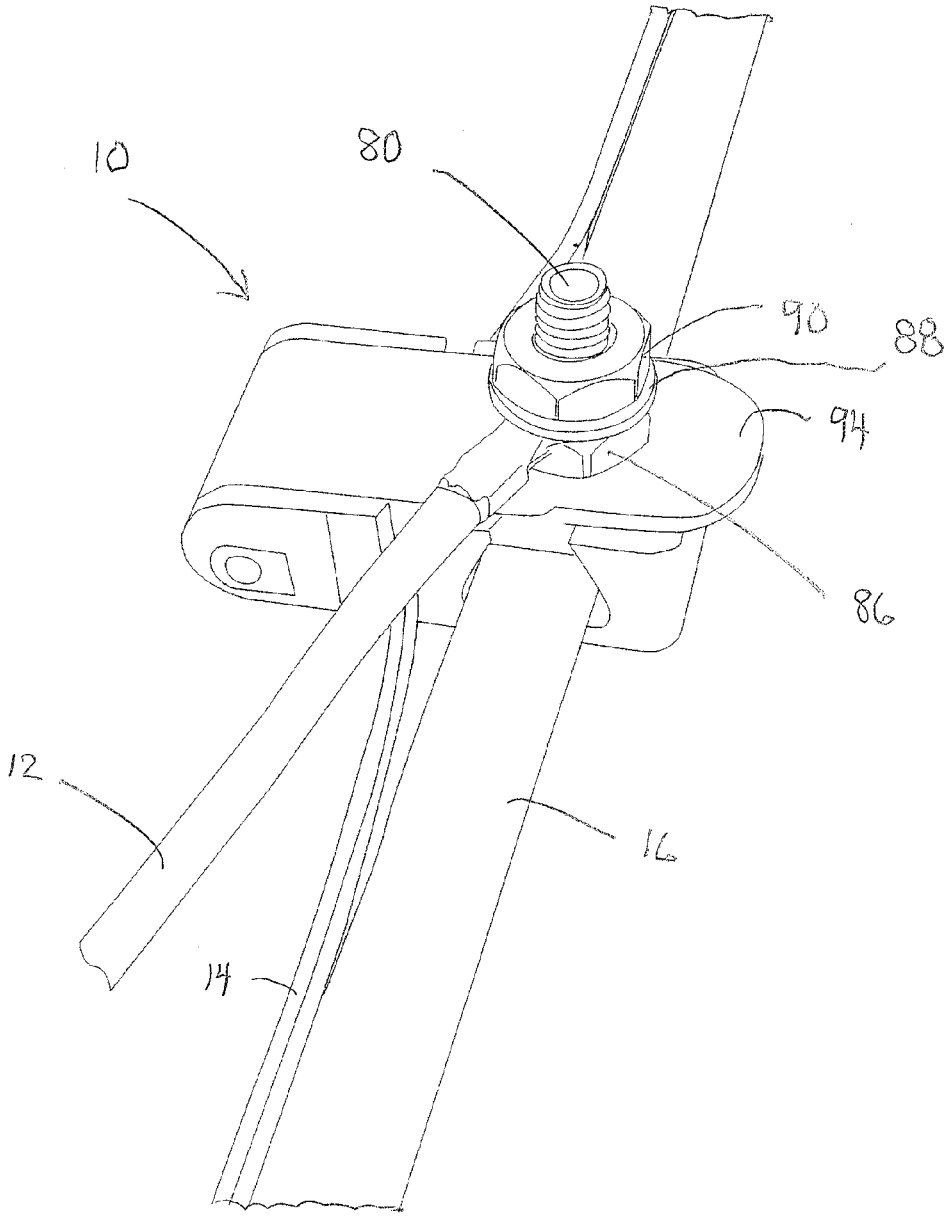
FIG. 2 is a perspective view of the locate wire connector of FIG. 1 as installed with a portion of a fiber optic cable and a portion of an installed grounding wire.

With reference to the drawings wherein like numerals represent like parts throughout the several Figures, a locate wire connector is generally designated by the numeral 10. As best illustrated in FIG. 2, the locate wire connector 10 is employed to connect with a ground wire 12 for grounding the locate wire 14 of a fiber optic cable 16. The locate wire connector 10 has particular applicability in connection with grounding a No. 24 AWG locate wire or a toneable fiber flat drop cable in a handhole or a pedestal or at a residence.

The locate wire connector 10, upon installation, functions as a strain relief and is significantly more stable than typical conventional grounding connections. The locate wire connector 10 can be efficiently employed in the handhole without introducing lightning discharges in the Optical Network Terminal (ONT) or the Optical Network Unit (ONU). In addition, the locate wire connector may be installed without stripping the locate wire and provides a grounding connection that is waterproof for underground installations.

Figure 1:
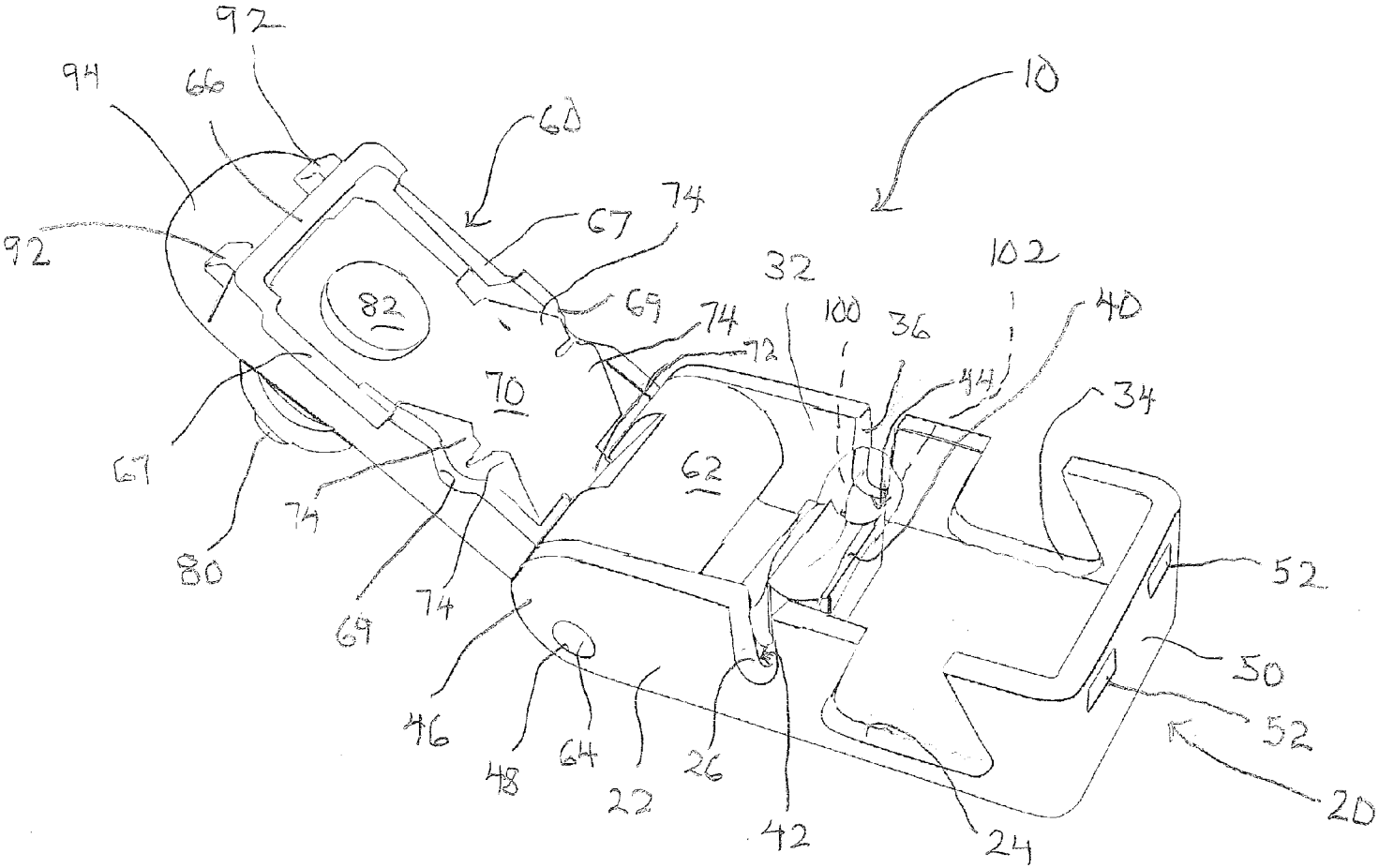
FIG. 1 is a perspective view, partly in phantom, of a locate wire connector in an open position prior to installation.

With reference to FIG. 1, locate wire connector 10 comprises a box-like receiving base 20 which pivotally connects with a cover 60 to provide an efficient grounding connection for locate wire 14, as will be detailed below. The base 20 has transversely opposed sides 22 and 32 which each have substantially identical aligned fiber cable grooves 24, 34 and locate wire grooves 26, 36. The grooves 24, 34, 26, 36 define side openings in the base. The cable grooves 24, 34 are dimensioned to receive the fiber optic cable 16 and have a generally restricted upper portion which frictionally retentively engages the received fiber optic cable 16.

Figure 4:
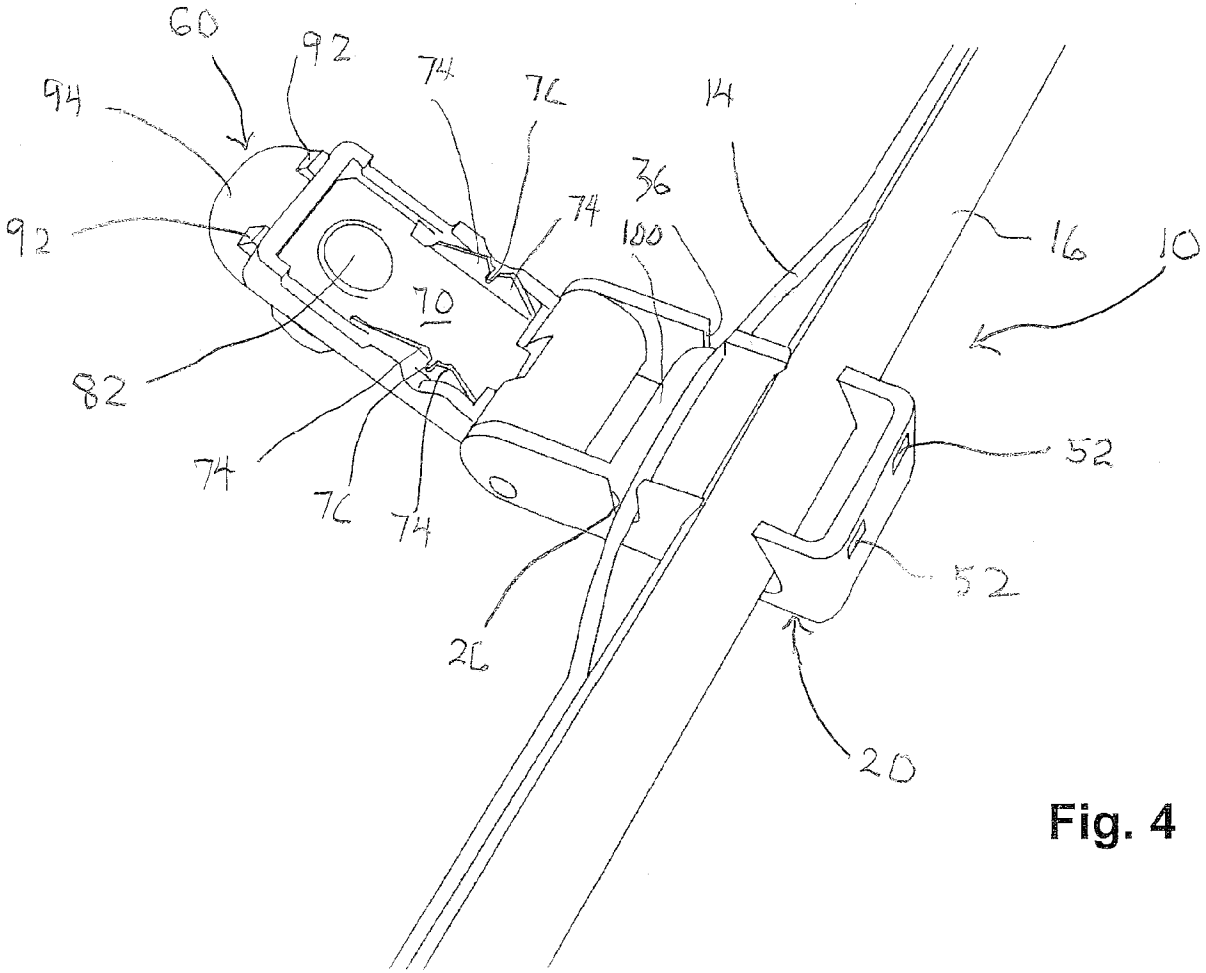
FIG. 4 is a perspective view of a locate wire connector in an open position with a fiber optic cable and locate wire further illustrating a locate wire grounding method.
Figure 5:
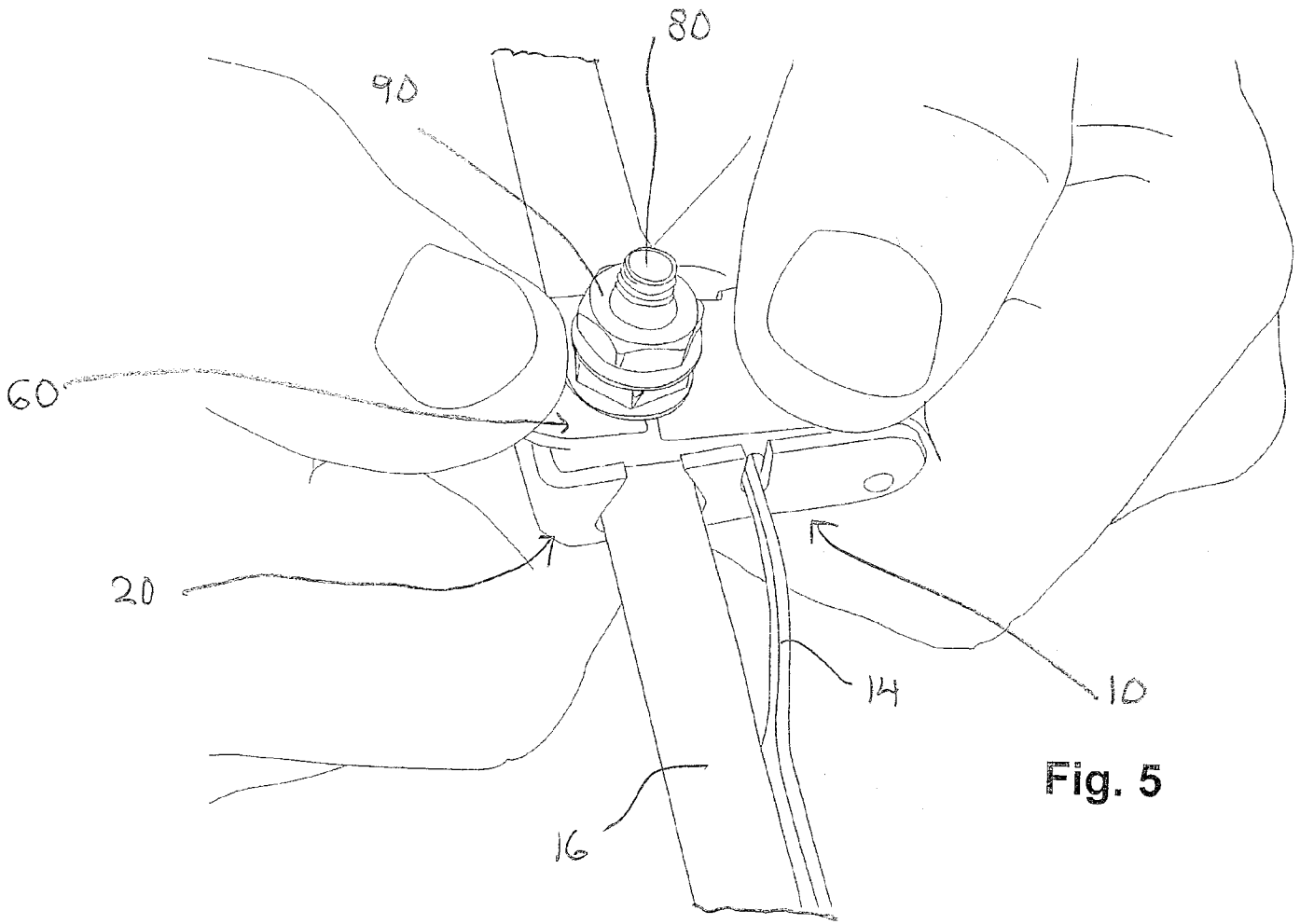
FIG. 5 is a perspective view of a locate wire connector and a portion of a fiber optic cable with a locate wire and a schematically illustrated lineman's hands further illustrating a step in the locate wire grounding method.

The base 20 includes a bottom panel 30 with an upwardly projecting cradle 40 which extends transversely of the base in general alignment with the locate wire grooves 26, 36. The locate grooves are dimensioned and positioned to receive a separated portion of the locate wire once it is partially separated away from the carrier portion of the fiber optic cable (See FIG. 4). A pair 14 of gaps 42, 44 are located above the bottom panel 30 of the base between the end of the cradle 40 and a lower vertex extension of the locate wire grooves.

A pair of parallel forward extensions 46 of sides 22, 32 have aligned openings 48 which receive a hinge 62 of the cover 60. The cover is secured via a hinge pin 64 or a pair of integral pins received in the openings 48. The rear side 50 of the base has a pair of detents.

The cover 60 pivots from the open pre-installation position of FIG. 1 to the fully closed installation position of FIG. 2. The underside of the cover includes a shallow lip 66 which forms two pairs of transversely opposed slots. The slots 67 align with the grooves 24, 34 and slots 69 align with the grooves 26, 36 when the cover is pivotally closed onto the base. The lip 66 is dimensioned so that it nestles inside the top portions of sides 22, 24 and 50 in the closed position. In addition, the slots 67, 69 respectively engage the top portions of the received cable 16 and locate wire 14.

The underside surface of the cover includes a conductive member 70 in the form of a copper or brass plate which is bent and shaped as further described. The member 70 has an extension 72 at one end for engaging a recessed wall of the hinge. Transversely opposed portions of the conductive member 70 are folded generally perpendicular to a central planar portion and include a pair of transversely opposed stripper blades 74 which cooperate to form an intermediate slot 76. The slots 76 receive the locate wire 14 and the blades 74 slice into the locate wire insulation to establish electrical contact with the conductor of the locate wire.

A threaded stud 80 has a flat head 82 which engages the underside of the conductive member 70 and extends through the top of the conductive member of the cover to stake the conductive member to the cover. The stud 80 is secured to the cover by a washer 84 and a nut 86. A second washer 88 and nut 90 is threaded to the stud. The forward end of the cover includes a pair of tabs 92 which align with, and are received in, the detents in snap-fit fashion when the cover is pivoted to the closed position. A forward lip 94 extends over the rear side 50 of the base in the closed position and provides a sufficient surface to engage the cover and pivotally pull same to the opened position.

Figure 3:
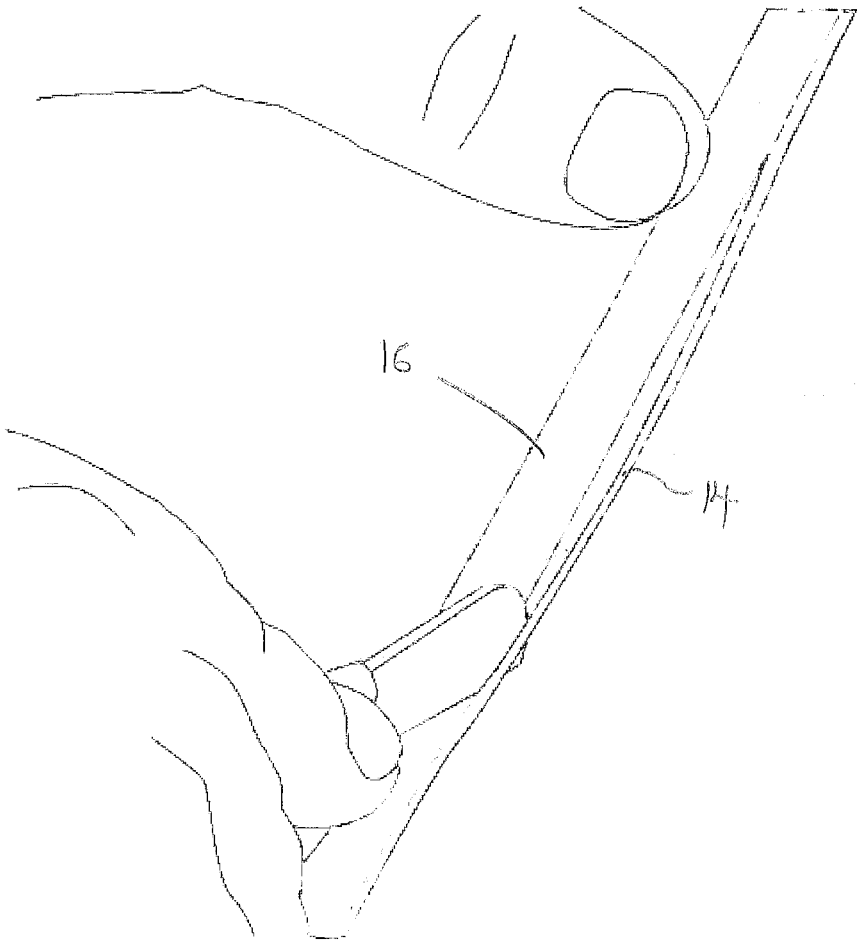
FIG. 3 is a perspective view of a portion of the fiber optic cable with a locate wire schematically illustrating a lineman manipulating a tool partially illustrating the locate wire grounding method.

The locate wire connector 10 may be efficiently installed to provide a grounding connection for a locate wire 14, such as illustrated in FIG. 2. Initially, an 8" separation slit is made in the web of the fiber drop cable as illustrated in FIG. 3. For a handhole grounding, the slit is preferably in the first slack coil on the bottom of the handhole.

Figure 6:
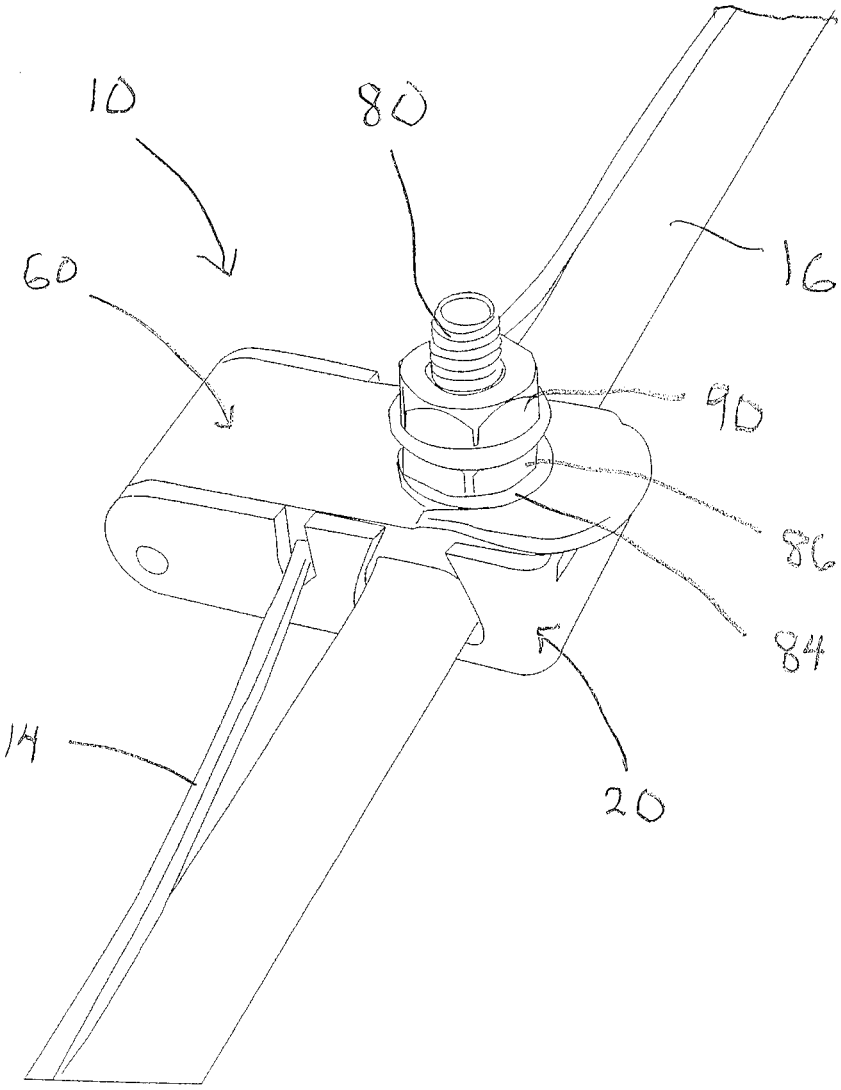
FIG. 6 is a perspective view of the locate wire connector of FIG. 1 as installed on a portion of a fiber optic cable with a locate wire further illustrating a step in the locate wire grounding method.

A gel 100, which may be in capsule form, is pre-positioned in or dropped into the base cavity region of the cradle 40 for the locate wire and the locate wire grooves 26, 36 and slots 42, 44. A release paper 102, which preferably covers the gel is removed. The locate wire is positioned in the grooves 26, 36 of the gel-filled base, locate wire receiving region and then the cover 60 is closed over the base, the received locate wire and the fiber optic cable. It should be appreciated that the conductive member makes electrical communication with the locate wire conductor via the stripping blades 74 which displace the insulation as the locate wire 76 moves through the slots 76. The geometry of the slots 76 and the retentive features of the grooves 26, 36 and the cradle 40 cooperate to prevent severing of the locate wire connector. The detents 52 receive the tabs 92 so that the connector is in a stable closed position shown in FIGS. 2 and 6. In some embodiments and applications, the gel is not required.

Figure 7:
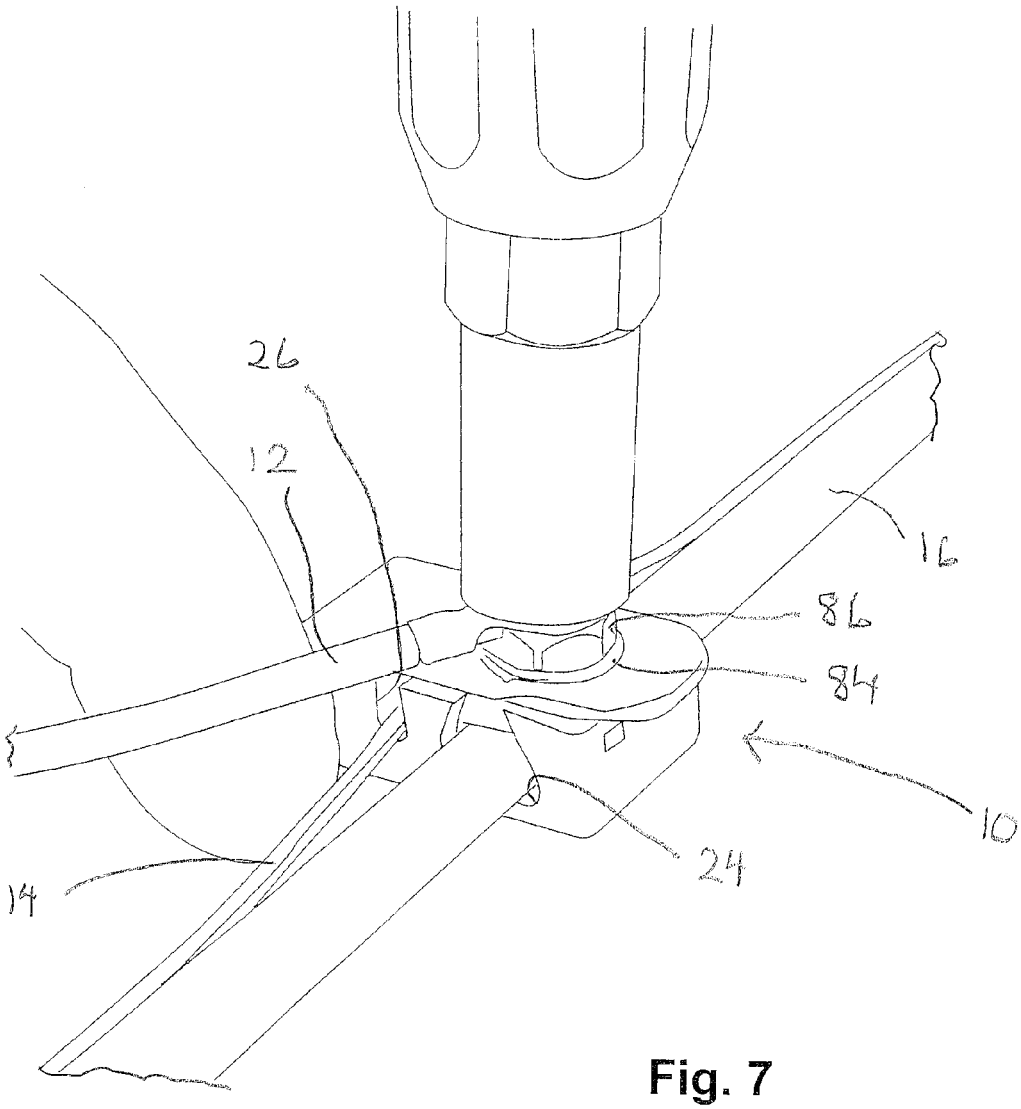
FIG. 7 is a perspective view of the locate wire connector of FIG. 1 as installed on a portion of a fiber optic cable with a locate wire, an installation tool and a schematically illustrated lineman's finger further illustrating a locate wire grounding method together with a portion of a ground wire.

With reference to FIG. 7, a green ground wire 12 is attached to the stud 80 on the connector 10 and to one of the studs (not illustrated) on the ground block (not illustrated). The locate wire is sufficiently grounded without requiring the stripping of the locate wire, and the connector 10, with the gel 100, provides a grounding connection that is waterproof for underground installations.

If necessary, a reverse force applied to the bill 94 will cause the tabs 92 to release from the detents 52 and allow the connector 10 to be reopened by reverse pivoting the cover 60 from the base 20.

The invention claimed is:

1. A locate wire connector comprising:

a base defining a groove for a cable and a spaced groove for a locate wire;

a cover hinged to said base and having a first interior side and a second exterior side;

a conductive member mounted to said first side and comprising a stripper slot alignable with said locate wire slot; and a stud assembly configured to connect a ground wire extending from said second side and in electrical communication with said conductive member;

wherein when a cable is received in said cable groove and a locate wire is received in said locate wire groove and said cover is closed over said base, said stud assembly electrically communicates with said locate wire.

2. The locate wire connector of claim 1 wherein said cable groove is shaped to form a restricted recess.

3. The locate wire connector of claim 1 wherein said base comprises a bottom panel and a locate wire cradle extends from said bottom panel and is aligned with said locate wire groove.

4. The locate wire connector of claim 1 wherein said stud assembly comprises a threaded member having a head which engages against said conductive member and exteriorly receives a pair of nuts.

5. The locate wire connector of claim 1 wherein said cover further comprises a pair of tabs and said base has a pair of detents which receive said tabs when the cover is closed.

6. The locate wire connector of claim 5 wherein said cover has an extended bill.

7. The locate wire connector of claim 1 wherein said cable groove and said locate groove are each defined by transversely spaced recesses in opposed side panels of said base.

8. The locate wire connector of claim 7 wherein said conductive member is a conductive plate which is bent perpendicularly at two transversely spaced locations and forms a pair of opposed stripper blades at each side of said stripper slot.

9. The locate wire connector of claim 8 wherein in a closed position, said stripper blades are disposed between the locate wire cradle and said locate wire grooves.

10. A method for grounding a locate wire comprising:

providing a hinged connector with a base and a hinged cover;

partially separating the locate wire from an optic cable;

placing said locate wire and optic cable in said base;

closing said cover to thereby establish electrical communication with said locate wire; and connecting a ground wire to said cover to provide electrical communication between said ground wire and said locate wire.

11. The method of claim 10 wherein the step of connecting a ground wire further comprises tightening an end portion of said ground wire by torquing a nut mounted on said cover.

12. The method of claim 10 further comprising placing a gel in said connector prior to closing said cover.

13. The method of claim 10 further comprising securing said closed position by forcing tabs of said cover into detents of said base.

14. The method of claim 10 further comprising displacing insulation from said locate wire as said cover closes onto said base.

15. The method of claim 14 wherein the step of partially separating the locate wire from an optic cable further comprises slitting the web between said locate wire and said optic cable.

16. A locate wire grounding installation comprising:

a fiber optic cable with a locate wire partially separated from said cable;

a connector capturing said cable and said locate wire in spaced separated relationship;

a conductor member disposed interiorly of said connector and electrically communicating with said locate wire and with an exteriorly accessible stud; and a grounding wire secured to said stud.

17. The installation of claim 16 wherein a gel covers said stripper blades.

18. The installation of claim 16 wherein said connector comprises a base and a hinged cover which pivots between an opened and a closed position and captures said fiber optic cable and a separated portion of said locate wire in said closed position.

19. The installation of claim 16 wherein said locate wire has a central conductor covered by insulation and said connector comprises stripper blades which sever insulation around said locate wire and electrically communicate with said locate wire conductor.

20. The installation of claim 19 wherein said stripper blades and locate wire are positioned and aligned to prevent said stripper blades from severing the central conductor of said locate wire.

* * * * *